United States Patent [19]

Hipp et al.

[11] Patent Number: 5,038,501

[45] Date of Patent: Aug. 13, 1991

[54] PUMP HAVING A ROTARY TWO-POSITION SELECTOR VALVE FOR A STEAM/SPRAY IRON

[75] Inventors: Edgar Hipp, Limonest; Alain Serriere-Gerard, Dardilly, both of France

[73] Assignee: Black & Decker Inc., Newark, Del.

[21] Appl. No.: 536,800

[22] Filed: Jun. 12, 1990

[51] Int. Cl.[5] ..... D06F 75/06; D06F 75/14

[52] U.S. Cl. ..... 38/77.5; 38/77.7; 38/77.8

[58] Field of Search ..... 38/3, 74, 77.1, 77.3, 38/77.5, 77.7, 77.8, 77.81, 88, 94; 222/255, 282, 283, 330, 331, 335, 340, 370, 380, 383

[56] References Cited

U.S. PATENT DOCUMENTS

| | | | |
|---|---|---|---|
| 3,041,757 | 7/1962 | Swenson et al. | 38/77 |
| 3,077,900 | 2/1963 | Ehrmann et al. | 38/77.5 X |
| 3,881,265 | 5/1975 | Eaton et al. | 38/77.5 |
| 4,104,815 | 8/1978 | Hammer et al. | 38/77.5 |
| 4,170,835 | 10/1979 | Bain, Jr. | 38/77.5 |
| 4,398,364 | 8/1983 | Augustine et al. | 38/77.5 |
| 4,594,801 | 6/1986 | Gronwick et al. | 38/77.5 X |
| 4,606,479 | 8/1986 | Van Brocklin | 222/380 X |
| 4,863,070 | 9/1989 | Andris | 222/383 X |

FOREIGN PATENT DOCUMENTS

| | | | |
|---|---|---|---|
| 0080634 | 11/1981 | European Pat. Off. . | |
| 0258253 | 7/1988 | Fed. Rep. of Germany | 38/77.5 |
| 1442883 | 8/1964 | France . | |
| 2371540 | 11/1976 | France . | |
| 2488296 | 8/1980 | France . | |
| 2083569 | 8/1980 | United Kingdom . | |

*Primary Examiner*—Werner H. Schroeder
*Assistant Examiner*—Ismael Izaguirre
*Attorney, Agent, or Firm*—Barry E. Deutsch

[57] ABSTRACT

A steam iron pump assembly including a two-position selector having one position corresponding to a sudden discharge of steam and having its other position corresponding to spraying cold water. The pump assembly comprises a pump body surmounted by a deformable bellows, and having two side outlets together with a rotary selector passing through the deformable bellows. A bottom portion of the rotary selector is surrounded by a sealing sleeve which is radially deformable with one or other of the two side outlets from the pump body. The shape of the bottom portion is suitable, depending on the angular position of the rotary selector for applying the sleeve against one of the outlet orifices while simultaneously allowing water to pass through the other outlet orifice.

19 Claims, 4 Drawing Sheets

PUMP HAVING A ROTARY TWO-POSITION SELECTOR VALVE FOR A STEAM/SPRAY IRON

BACKGROUND OF THE INVENTION

The invention relates to a steam iron pump assembly including a two-position selector with a first position for obtaining a sudden discharge of steam and a second position for obtaining a spray of cold water.

In general, steam irons comprise a heating soleplate having a series of steam outlet holes in its bottom face and a steam-generating chamber in its top face which is in communication with said holes and which also communicates with a tank of water via an adjustable low flow rate tap under the control of a rotary knob placed on the top portion of the iron.

More precisely, steam irons are generally fitted with a pump suitable for taking a quantity of water from the tank and for delivering said quantity via a selector member either into the steam-generating chamber in order to obtain a sudden and abundant discharge of steam through the holes in the soleplate, or else into a cold water spray head situated towards the front of the iron. A sudden discharge of steam or "steam surge" is advantageous for creasing thick cloth, e.g. trouser creases. Cold water is sprayed to eliminate unwanted wrinkles, in particular in cloth which is too dry.

Reference may be made, for example, to U.S. Pat. Nos. 3,747,241, 3,664,045 and 3,041,756, or else to French patent numbers 2,488,296, 2,371,540 and 2,212,457.

In a first approach, systems are proposed in which the functions associated with the pump and with the selector are separate: there is thus an independent selector connected downstream from the pump and having two outlets for directing water to one or other of two pipes associated respectively with discharging additional steam and with spraying cold water.

In general, these systems are expensive and they often suffer from leakage problems.

By way of example, particular mention may be made of U.S. Pat. No. 3,599,357 in which FIG. 8 illustrates a rotary selector mounted inside an iron and actuated by a rod extending through the top portion of the iron. The rotary selector is made in the form of a two-outlet cylindrical valve. Sealing is very difficult to obtain with such a design and its structure greatly complicates assembly operations. A more recent design of the same type, as shown in French patent number 2,439,841, may also be mentioned.

The steam iron described in that patent is still commercially available and it includes an independent selector made in the form of a tray having an inlet orifice and two outlet orifices in communication therewith, with the top of the tray being closed by a rotary actuator lever in the form of a plate having a circular bottom opening capable of putting the inlet orifice into communication with one or other of the outlet orifices, depending on the angular position of the lever.

This solution appears to be simple, but in fact it suffers from numerous problems, essentially related to keeping the rotary lever in position by means of a metal clamp having one arm pressing the lever against the tray. The rotary lever must be accurately positioned axially in order to avoid any defect in perpendicularity: and this means that the metal clamp must apply a considerable clamping force on a part which needs to be operated manually. In addition, the rotary lever itself serves to provide the sealing of the system and this is a drawback with respect to reliability in sealing. Finally, the central body of the selector is expensive to fabricate.

In another approach, attempts have been made to provide integrated assemblies in which the two functions associated with the pump and with the selector are provided by a single functional unit.

A fairly old design implementing this approach is shown in French patent number 2,137,466.

The pump assembly described in this patent comprises a pump body constituting the rotary selector of a plug-type cock or tap. The bottom portion of the pump body is then provided with a conical extension having a lateral orifice, said conical extension being surrounded by a conical rubber sleeve having two opposite orifices and prevented from rotating by a pin. Once the selector has been rotated into the desired position, a piston rod is actuated to expel water into the corresponding pipe.

Sealing is difficult with such a design in spite of a spring cup urging the pump body against the inside wall of the conical sleeve, and sealing becomes worse with aging by virtue of the rubber losing flexibility. In addition, the sleeve is subject to wear due to friction against the inevitable machining flash around the side orifice in the pump body. Finally, manufacturing tolerances are necessarily tight in order to avoid having large forces which would increase wear and, in the limit, would run the risk of jamming the rotary selector.

More recently, systems have been proposed having a rotary pump body mounted over a fixed part carrying the suction inlet and both liquid outlets, optionally together with an intermediate rotary seal.

Such a design is illustrated, for example, in French patent numbers; 2,516,561 and 2,488,659.

French patent number 2,516,561 describes a pump assembly of complex structure having a large number of gaskets, including a rotary seal in the form of a curved half-lip which is difficult to make and to install. In addition to the difficulty in obtaining sealing, this pump assembly suffers from other major drawbacks inherent to its very design: it is difficult to assemble (there are numerous close tolerances), high friction on large diameters requires lubricating grease to be employed, and the overall size of the assembly remains relatively large.

A similar design is shown in French Patent No. 2,488,659. In this pump assembly, the bottom is likewise covered by a rotary seal, however in this case the seal is also required to provide peripheral sealing, thereby further complicating the system.

SUMMARY OF THE INVENTION

The object of the invention is to provide an integrated type of pump assembly implementing the second above-mentioned approach, but avoiding the above-mentioned drawbacks.

A more particular object of the invention is to provide a pump assembly which is highly satisfactory with respect to sealing and reliability, which is simple in design, having as few parts as possible, which is relatively small in size, and which is easy to assemble.

More precisely, the present invention provides a steam iron pump assembly with a two-position selector having a first position for obtaining a sudden discharge of steam and a second position for obtaining a spray of cold water, the pump assembly comprising:

a pump body surmounted by a deformable bellows defining a pump chamber, the bottom of the pump body having a suction duct and two vertically spaced-apart side outlets each opening out via an associated orifice into a central hollow of said body;

a rotary selector inside the deformable bellows and including a bottom portion disposed inside the central hollow of the pump body, and including a top actuator portion constrained to rotate with said bottom portion, said top and bottom portions being free to slide axially relative to each other; and a sealing sleeve directly surrounding the bottom portion of the rotary selector level with the two side outlets from the pump body;

said assembly further including the bottom portion of the rotary selector having an outline making it possible, depending on the angular position of said rotary selector, to apply the sealing sleeve against either one of the outlet orifices while simultaneously allowing water to pass to the other outlet orifice.

Preferably, the sealing sleeve is essentially stationary in the associated central hollow of the pump body and is deformed radially level with the side outlets from the pump body by the outline of the bottom portion of the rotary selector. In particular, the bottom portion of the rotary selector has two identical outlines which are angularly offset from each other, and which are spaced apart vertically to correspond with the side outlets from the pump body: for example, the outlines of the bottom portion of the rotary selector are generally rectangular in shape and/or are offset by about 90°.

It is also advantageous for the central hollow of the pump body to have a cross-section which is uniform axially, said cross-section defining a complex outline forming axial thrust faces for compressing the sealing sleeve against one or other of the outlet orifices, and side depressions enabling water to pass around said sleeve; in particular, two small axial facettes may be provided on either side of each outline orifice extending substantially perpendicularly to the axis of each side outlet, and an opposite, larger axis facette may also be provided parallel to said small facettes.

Also advantageously, each of the side outlets from the pump body is provided with a non-return valve preventing air being sucked in therethrough, and facilitating pump priming.

Also advantageously, the top portion of the rotary selector comprises an actuator lever outside the deformable bellows and an intermediate shaft passing through said bellows and providing the rotary connection between said actuator lever and the bottom portion of said rotary selector; in particular, the bottom end of the intermediate shaft may slide in a complementary axial hollow in the bottom portion of the rotary selector, with the corresponding cross-sections being preferably substantially rectangular.

Also advantageously, the actuator lever is mounted on a pushbutton for actuating the pump in both of the angular positions of the rotary selector, in particular the actuator lever and the intermediate shaft are constituted by a single part.

In a variant, the pushbutton, the actuator lever, and the intermediate shaft constitute a single part, or else the pushbutton and the actuator lever constitute a single part.

It is also advantageous for the intermediate shaft to have a cylindrical portion where it passes through the deformable bellows and for said deformable bellows to be provided with a small cylindrical sleeve in which said cylindrical portion is received, with the inside wall of the small cylindrical sleeve being provided with circular grooves in order to improve sealing; in particular the cylindrical portion of the intermediate shaft may come into abutment against the bottom portion of the rotary selector at the end of the pump-actuating stroke.

Also advantageously, the axial hollow complementary to the bottom portion of the rotary selector may extend to the bottom end of said portion by means of a bore for the purpose of balancing pressure inside the pump.

Other features and advantages of the invention appear more clearly in the light of the following description of a particular embodiment with reference to the accompanying drawings, in which:

DESCRIPTION OF THE PREFERRED EMBODIMENT

Figure 1:
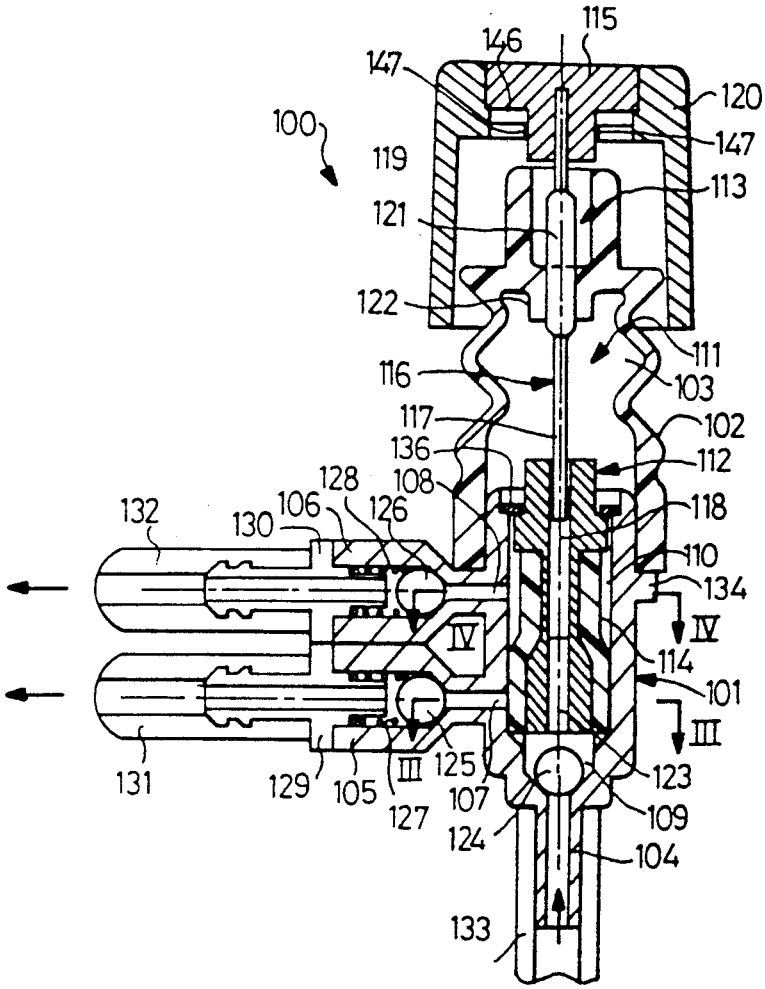
FIGS. 1 and 2 are two axial sections through a pump assembly in accordance with the invention, with the rotary selector being shown in its position for sudden discharge of steam.
Figure 2:
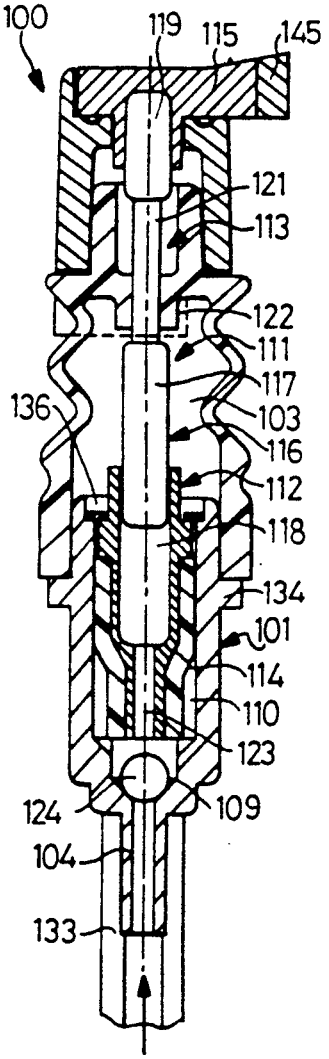

The sections of FIGS. 1 and 2 show a steam iron pump assembly 100 in accordance with the invention. This pump assembly is of the type having a two-position selector in which a first position serves to obtain a sudden discharge of steam or "steam surge", and a second position serves to obtain a spray of cold water.

The pump assembly 100 comprises a pump body 101 surmounted by a deformable bellows 102 defining a pump chamber 103. The bottom of the pump body 101 has a suction duct 104 together with two lateral outlets 105 and 106 one above the other and opening out via respective orifices 107 and 108 into a central hollow 110 of said pump body. It should be observed that, in this case, the pump body 101, together with its suction duct and its two side outlets, constitutes a single part which is preferably made of plastic material. The bottom of the pump body 101 has a suction orifice 109 which may optionally be closed by a ball 124, however the ball is not essential given the way in which the pump assembly 100 operates, as explained below. Each of the outlets of the pump body operates, as explained below. Each of the outlets of the pump body 101 is preferably fitted with a non-return valve for preventing air being sucked in and also for facilitating pump priming. In the example shown, the non-return valves are constituted by two balls, 125 and 126 associated with respective ones of the outlets 105 and 106 of the pump body 101. The balls 125 and 126 are urged into place by respective associated springs 127 and 128. The outlets 105 and 106 are also fitted with respective end fittings 129 and 130, with each end fitting being suitable for receiving a flexible hose 131 and 132. The side outlet 106 may correspond, for example, to sudden discharge of steam or "steam surge", while the lower side outlet 105 corresponds to spraying cold water. The bottom section end piece 104 is similarly capable of being fixed to a flexible hose 133 whose other end dips into the water tank of the iron (not shown). The pump body 101 finally also includes a shoulder 134 serving as an abutment to the bottom portion of the deformable bellows 102 surmounting the pump body.

Figure 16:
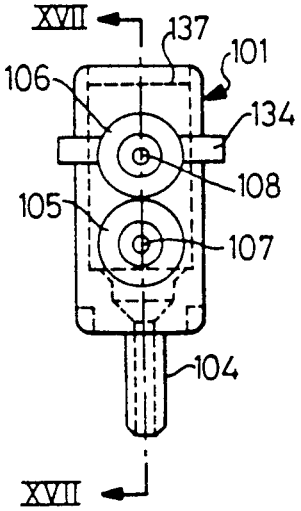
FIGS. 16 and 18 are an elevation and a plan view of the pump body.
Figure 17:
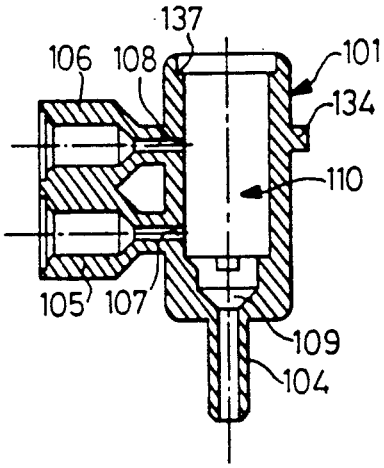
FIG. 17 is a section on line XVII—XVII of FIG. 16.
Figure 18:
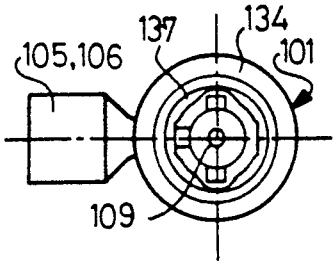

The structure of the pump body 101 in the pump assembly 100 will be better understood with reference to FIGS. 16 to 18. However, the description below deals in greater detail with the cross-section of the central hollow 110 of the pump body 101, which section defines a complex outline which is described with reference to FIG. 19.

In accordance with an essential aspect of the invention, the pump assembly 100 includes a rotary selector 111 passing through the deformable bellows 102 and including a bottom portion 112 disposed in the central hollow 110 of the pump body 101, together with a top actuator portion 113 constrained to rotate with said bottom portion but capable of sliding axially relative thereto. The pump assembly also includes a sealing sleeve 114 directly surrounding the bottom portion 112 of the rotary selector 111 level with the two side outlets 105 and 106 of the pump body 101

In accordance with an essential characteristic of the invention, the bottom portion 112 of the rotary selector 111 has an outline making it possible, depending on the angular position of said rotary selector, to apply the sealing sleeve 114 against one or other of the outlet orifices (107 or 108) while simultaneously allowing water to pass to the other one of the outlet orifices (107 or 108).

With such a design, it is possible to provide an essentially stationary sealing sleeve 114 inside the associated central hollow 110 of the pump body 101, with the sealing sleeve being deformed radially only, level with the side outlets 105 and 106 from said pump body, by the outline of the bottom portion 112 of the rotary selector 111. It is even possible to provide for rotation to be completely prevented by providing projecting ribs in the central hollow 110 of the pump body 101, or even to glue the base of said sleeve to the facing wall of the pump body.

The feature of the deformable sleeve being essentially stationary in rotation is particularly advantageous in practice since it makes it possible to reduce the friction at the outlet orifices 107 and 108 considerably, unlike prior art embodiments using a sleeve (a non-deformable sleeve) which is caused to rub against the outlet orifices. Such a system also has the advantage of taking up very considerable amounts of slack, thereby enabling manufacturing tolerances to be used which are much less severe than for prior art designs. Thus, the desired outlet is selected solely by radial deformation of the sealing sleeve 114, with said deformation occurring simultaneously in that portion of the sleeve which faces the bottom orifice 107 and the other portion which faces the other orifice 108, with both deformation effects being organized about an angular offset as explained below.

The very particular structure of the bottom portion 112 of the rotary selector 111 will be better understood on referring to FIGS. 8 to 13.

Firstly, there is an annular shoulder 135 whose main function is to keep the sealing sleeve 114 in position engaged between the bottom edge of said shoulder and the tapering end of the central hollow 110 in the pump body 101. This shoulder 135 may also be used for holding the bottom portion 112 of the rotary selector 111 in axial position within the pump body 101, by means of a washer 136 bearing against the top edge of said shoulder and also against a shoulder 137 provided in the top portion of the pump body 101 (which shoulder 137 is visible in FIGS. 17 and 18).

Beneath the shoulder 135, there is a set of two identical outlines at an angular offset to each other and at different levels so as to correspond with respective ones of the side outlets 105 and 106 of the pump body 101. The outlines of the bottom portion 112 are generally rectangular in shape in this case, as can clearly be seen from the sections shown in FIGS. 11 and 12. It should be observed that the outlines of the bottom portion 112 of the rotary selector 111 are offset from each other in this case by about 90°.

Naturally, other shapes of non-cylindrical outline could also be envisaged, and/or other angular offsets could also be used.

Thus, when the pump assembly 100 occupies the position shown in FIGS. 1 and 2 (the "steam surge" position), i.e. when the rotary selector 111 occupies an angular position such that the sealing sleeve 114 is pressed closely against the orifice 107 of the outlet 105, then the other orifice 108 is automatically disengaged, given that the radial deformation of the sealing sleeve 114 is then applied in a direction which is substantially perpendicular to the first direction of radial deformation causing the bottom orifice 107 to be closed. In this case, when the pump is actuated, water sucked in via the bottom duct 104 passes around the sealing sleeve 114 and reaches the top portion of the central hollow 110 from which it escapes via the orifice 108 of the outlet 106. When the rotary selector 111 is moved into its other angular position (spray position) the sealing sleeve 114 is then radially deformed in a manner symmetrical to that shown in FIGS. 1 and 2, i.e. the bottom orifice 107 is then disengaged while the top orifice 108 is closed. In this second position (which is not shown in the drawings), when the pump is actuated, water arriving via the suction duct 104 can escape only via the bottom orifice 107 of the outlet 105, such that the pipe corresponding to cold water being sprayed is the only one to be fed with water.

Figure 9:
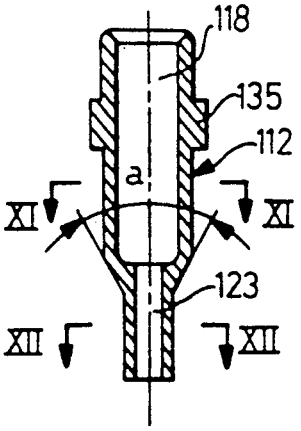
FIGS. 9 and 10 are associated axial sections.
Figure 10:
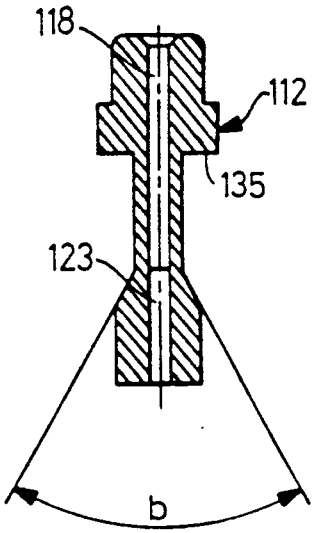
Figure 11:
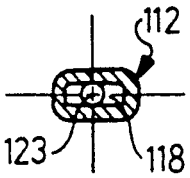
FIGS. 11 and 12 are sections on lines XI—XI and XII—XII of FIG. 9.
Figure 12:
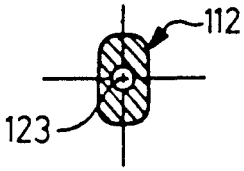
Figure 13:
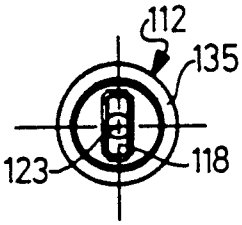

In addition, as shown in FIGS. 9 and 10, it is also possible to smooth the radial deformation of the sealing sleeve 114 to a considerable extent by providing conical transition facettes flared upwardly at an angle a and downwardly at an angle b. In particular, these angles a and b are preferably equal to each other and are selected to be about 60°.

Figure 19:
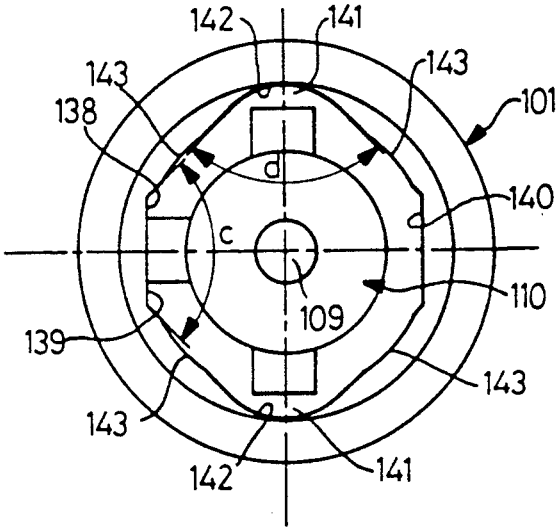
FIG. 19 is a (fragmentary) plan view of the pump body on a greatly enlarged scale for showing, more clearly, the complex outline of the cross-section of the central hollow in the pump body.

The very particular sealing method just described and based on the principle of applying two radial deformation effects at different levels of a cylindrical sealing sleeve, now requires the particular geometry of the central hollow 110 of the pump body 101 to be described in greater detail with reference to FIG. 19 which is a fragmentary plan view of the pump body on a much larger scale. FIG. 19 thus shows up more clearly the complex outline of the cross-section of the central hollow 110 in the pump body 101. This cross-section is generally octogonal in shape having segments as described below.

Firstly, it should be observed that the cross-section of the central hollow 110 is uniform in an axial direction of the pump body, said section defining a complex outline forming axially-extending thrust facettes 138 and 139 enabling the sealing sleeve 114 to be securely pressed against one or other of the outlet orifices 107 and 108. These two small axial facettes 138 and 139 are provided on either side of each outlet orifice 107 and 108 and thus extend substantially perpendicularly to the axis of each side outlet 105 and 106, and in addition a larger opposite axial (i.e. axially-extending) facette 140 is also provided parallel to said small facettes. The disposition of these axial thrust facettes thus makes it possible to compress the radially deformed part of the sealing sleeve 114 firmly against the associated orifice 107 or 108, thereby enabling excellent sealing to be obtained.

When considering a direction orthogonal to the direction of the axes of the outlets 105 and 106, two side depressions 141 can also be seen to enable water to pass around the sealing sleeve 114, with said side depressions being defined, for example, by outline portions in the form of circular arcs. The complex outline of the cross-section of the central hollow 110 also has pairs of sloping facettes 143 at angles c or d, sloping respectively from the axial thrust facettes and from the side depressions, where the angles c and d are preferably equal to each other and are selected to be substantially about 90°. Finally, these facettes are interconnected in the four peripheral zones concerned (at the ends of two diagonals) by circular arcs 142 coinciding, for example, with the base circle of the central hollow 110 prior to the hollow being shaped.

Figure 3:
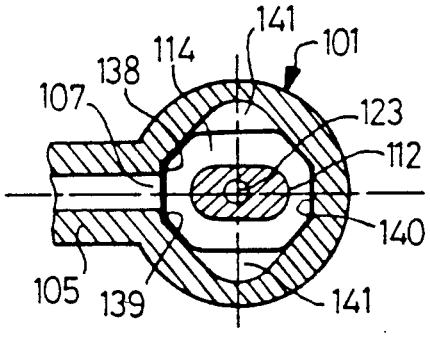
FIGS. 3 and 4 are sections on lines III—III and IV—IV of FIG. 1 in which the sealing sleeve is not shaded and illustrating the top and bottom zones of the rotary selector in the vicinity of the top and bottom outlets of the pump body.
Figure 4:
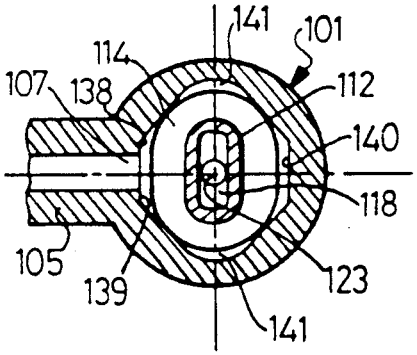

If reference is now made to the sections of FIGS. 3 and 4, the two fundamental positions of each of the zones of the radially deformable sealing sleeve 114 will be better understood:

In FIG. 3, the main direction of radial deformation of the sleeve 114 lies along the the axis of outlet 105 such that the sleeve 114 is compressed between the facette 140 and the two opposite facettes 138 and 139, thereby enabling the corresponding orifice 107 to be completely closed, while the side depressions 141 are at maximum volume, thereby allowing water to pass over the periphery of the sleeve 114.

In FIG. 4, the general deformation direction is orthogonal to that shown in FIG. 3, thereby releasing the sleeve 114 from making contact with the facette 140 or with the opposite small facettes 138 and 139, thereby releasing a path for a normal outlet flow via the orifice 107 of the outlet 105. In this position, the side depressions 141 are at minimal volume.

By way of example, a spacing of about 6.6 mm may be selected between the facette 140 and the small facettes 138 and 139, with a spacing of about 8 mm between the bottoms of the side depressions 141, in which case the diameter of the base circle (arcs 143) is about 6.9 mm.

The top portion 113 of the rotary selector 111 is now described in greater detail.

The top portion 113 of the rotary selector 111 includes an actuator lever 115 outside the deformable bellows 102 together with an intermediate shaft 116 which passes through said bellows and which provides a rotary connection between said actuator lever and the bottom portion 112 of the rotary selector 111. Thus, by acting on the actuator lever 115 of the rotary selector 111, it is easy to bring the bottom portion 112 into one or other of its two positions, in order to organize the feeding of water to the desired outlet 105 or 106.

The intermediate shaft 116 has a bottom end 117 which is suitable, in this case, for sliding in a complementary axial hollow 118 in the bottom portion 112 of the rotary selector, with the corresponding cross-sections being preferably substantially rectangular. In fact, since FIGS. 1 and 2 are shown on a large scale, the end 117 of the intermediate shaft 116 is, in practice, in the form of a thin blade suitable for sliding freely in the complementary axial hollow 118 of the bottom portion 112.

Figure 8:
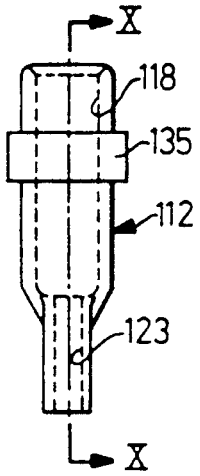
FIGS. 8 and 13 are an elevation view and a plan view of the bottom portion of the rotary selector.

FIGS. 8 to 10 clearly show the complementary axial hollow 118 which is extended in this case to the bottom end of the portion 112 by means of a cylindrical bore 123, enabling pressure within the pump to be brought into equilibrium. The bore 123 is not in any way essential, but it is advantageous for pressure-balancing purposes since it avoids setting up high pressure gradients, thereby limiting the risks of leakage in the event of pressure increasing, and also ensuring that the delivery rate remains uniform.

Above the end portion 117, the intermediate shaft 116 preferably has a cylindrical portion 121 where it goes through the deformable bellows 102, and to this end the bellows has a small cylindrical sleeve 122. Thus, the lever 115 can be actuated easily without deforming the bellows 102 radially where the intermediate shaft 116 passes therethrough.

Figure 20:
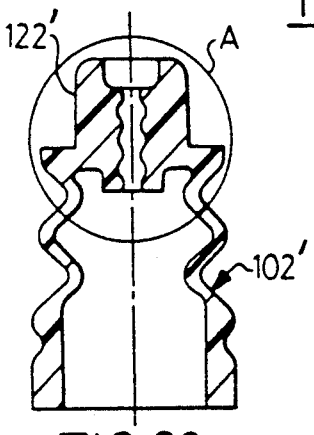
FIG. 20 is an axial section showing a variant of the deformable bellows.
Figure 21:
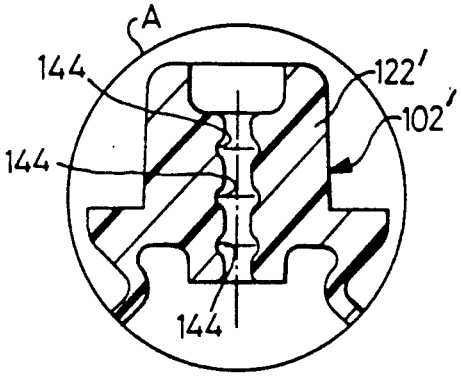
FIG. 21 shows a detail A of FIG. 20 on a larger scale.

In a particular embodiment, as shown in FIGS. 20 and 21, it is possible to provide circular grooves in the inside wall of the small cylindrical sleeve of the deformable bellows. In this case, the bellows 102' has a top end, which is slightly different from that of the above-described bellows 102, including a small top sleeve 122' provided with circular grooves 144 about its axial bore, as shown more clearly in FIG. 21. This makes it possible to define very good quality point contact between the cylindrical portion 121 of the intermediate shaft 116 and the small sleeve 122' of the sealing bellows 102', and grease may optionally be provided in the circular grooves 144 in order to provide a self-lubricating system encouraging flexible and reliable operation of the pump. It should also be observed that high-quality sealing is also provided at the bottom portion of the sealing sleeve by virtue of radial clamping around the top portion of the pump body 101.

Figure 7:
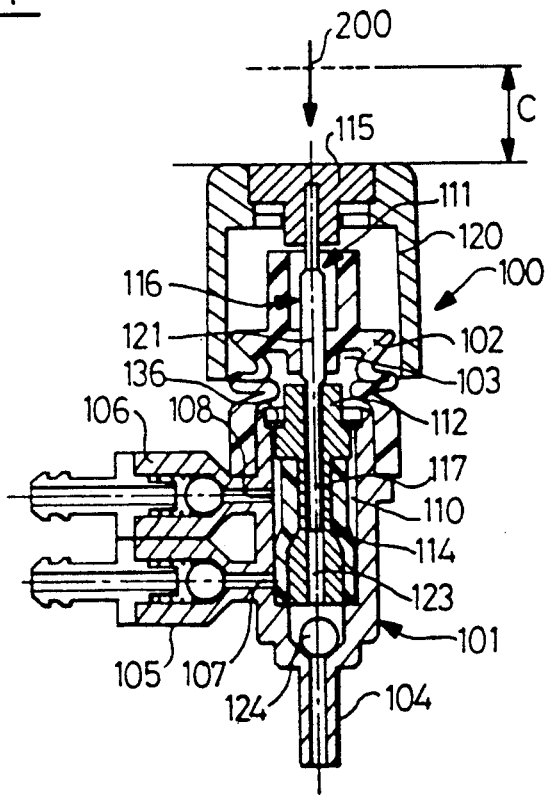
FIG. 7 is a section through the above pump assembly in an end-of-stroke position for actuating the pump.

In addition, if reference is made to the section of FIG. 7 showing the above-described pump assembly in its end of pump actuation stroke position which defines a stroke c once the assembly has been compressed in the direction of arrow 200, it is advantageous to provide for the cylindrical portion 121 of the intermediate shaft 116 to be able to come into abutment at the end of the pump actuation stroke against the bottom portion 112 of the rotary selector 111: in this way, by virtue of this end-of-stroke abutment, the intermediate shaft 116 is capable of lowering the bottom portion 112 should it have risen (which explains why the above-described washer 136 is not necessary in practice).

Above the cylindrical portion 121, the intermediate shaft 116 has a top end 119 for providing rotary coupling with the actuator lever 115 of the rotary selector 111. As can be seen in FIGS. 1 and 2, this top end 119 is in the form of a flat blade of essentially rectangular cross-section.

In addition, the actuator lever 115 is mounted in this case on a pushbutton 120 for actuating the pump in either of the angular positions of the rotary selector 111. Naturally, it is advantageous to integrate the actuator lever 115 fully in the top portion of the pushbutton 120, as shown herein, with one end 145 of the actuator lever being easily displaced with a finger. The actuator lever 115 may advantageously be integrated in the pump actuator pushbutton by a snap-fastening technique which facilitates both assembly and displacement of the actuator lever per se. This integration will be better understood on referring to FIGS. 5 and 6.

Figure 5:
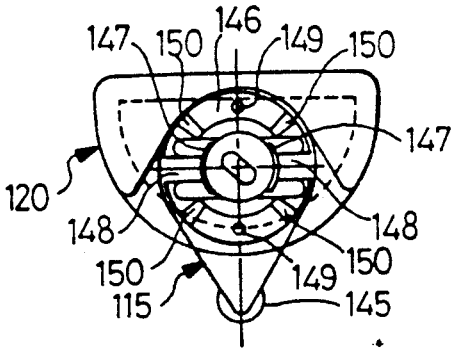
FIGS. 5 and 6 are plan views of the pump assembly for showing the actuator lever of the rotary selector mounted on the pump actuator button, shown respectively during assembly, and in an assembled position.
Figure 6:
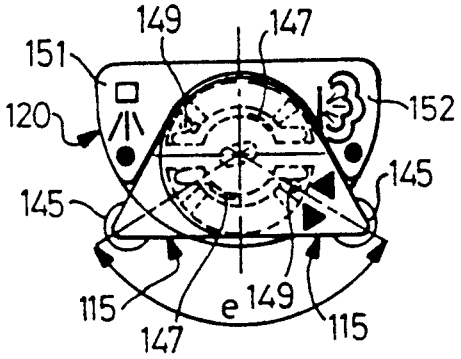

FIG. 6 shows a position for mounting the lever on the pushbutton 120. To this end, the shaft of the actuator lever 115 has two diametrically opposite annular projections 147 suitable for snap-fastening engagement with resilient tabs 148 fixed to the pushbutton 120. The button 120 also has annular shoulders 146 beneath which the projections 147 can pass after snap-fastening, with the assembly then being securely held together in either of the two operating positions as illustrated in FIG. 6. FIG. 5 also serves to show small bosses 149 provided on the underside of the actuator lever 115, said bosses being suitable for co-operating with radial projections 150 provided on the annular shoulders 146. Thus, in each of the operating positions, the operating lever clicks into position, thereby indicating to the person operating the lever that the desired lever position has indeed been obtained correctly. FIG. 6 also shows pictographs 151 and 152 on the top face of the pump actuator pushbutton 120 and corresponding respectively to the spray position and to the steam discharge position.

It should be observed that the angular stroke of the actuator lever 115, represented by angle e in FIG. 6, is about 120° in this case. This is not incompatible in any way with the angular offset of 90° mentioned above for the outline of the bottom portion 112 of the rotary selector 111. It can easily be seen that the structure of the pump assembly 100 can readily tolerate an angular range of plus or minus 15° relative to accurate angular positions without any loss of sealing at the closed outlet orifice from the pump body. This constitutes a major advantage compared with the prior art, and in particular with techniques making use of a plug-type cock having a side opening since an angular error of such magnitude would then prevent satisfactory operation.

In the embodiment described above, the top portion 113 of the rotary selector 111 is made up of three parts, namely the intermediate shaft 116, the actuator lever 115, and the pump actuator button 120. However, the number of parts may be reduced to two or even to one only.

Figure 14:
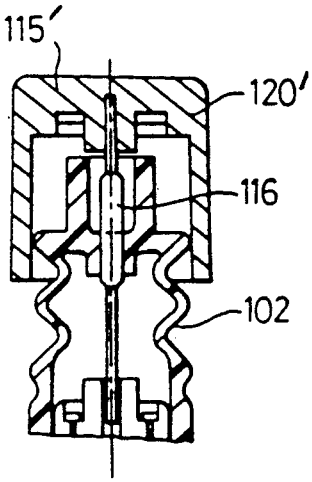
FIGS. 14 and 15 are fragmentary axial sections showing variants each including a single part respectively constituted by the plug and the rotary selector actuator lever, or by the rotary selector actuator and the intermediate linking shaft.
Figure 15:
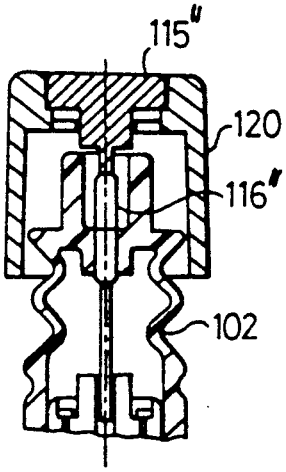

FIG. 14, thus illustrates a variant in which the actuator lever 115' and the button 120' constitute a single part. FIG. 15, shows another variant in which the actuator lever 115'' and the intermediate shaft 116'' constitutes a single part. These two variants could be combined by causing the actuator lever, the pushbutton, and the intermediate shaft to constitute a single part only (this variant is not shown).

Which variant is chosen will often depend on the substance chosen for making a part of the rotary selector. If the intermediate shaft 116 is made of metal, e.g. stainless steel, then the pushbutton and the actuator lever may be provided as a single part, in which case the outside shape of the pushbutton would be cylindrical rather than being semi-cylindrical as shown in FIGS. 5 and 6. However, the intermediate shaft could be made of a plastic material such as a polyamide or a polycarbonate, in which case a single component could be made constituting two or three of the above-mentioned items. The above described pump assembly has numerous advantages cover the prior art.

Firstly, it should be observed that it has a very small number of component parts, that they are small in size, and easily made by molding. Fundamentally, the pump assembly 100 comprises a pump body 101, a bottom portion 112 with its sleeve 114, a deformable bellows 102, and a rotary selector (made of one, two, or three parts, as the case may be). This small number is due, in part, to the fact that each of the parts performs a plurality of functions: for example the deformable bellows 102 serve both to define the deformable pump chamber and also to provide the return spring effect for the pump (thereby avoiding the need to add an additional return part), while simultaneously ensuring good sealing both where it meets the pump body (radial sealing), and where the intermediate shaft of the rotary selector passes therethrough.

It should also be observed that given the slack tolerances made possible by the novel structure, it is possible to make use of common materials for constituting the bottom portion of the rotary selector, e.g. a polyacetal.

The sealing of the system is excellent since the deformable sleeve is always compressed in a single direction over each of the orifices in a direction which substantially coincides with the axis of the orifice in question. It is important to observe that no other sealing component is required, with the sealing sleeve 114 and the bellows 102 sufficing on their own to provide all the sealing required in the assembly.

Such an embodiment also serves to avoid friction in the top portion of the rotary selector and this constitutes a considerable advantage over the prior art in which it is necessary to press the actuator lever against a sealing face by means of an additional part.

In addition to the slack tolerances possible both with respect to machining and with respect to the angular strokes used in operation (it is recalled that an error of plus or minus 15° on the position of the bottom portion of the rotary selector has no effect on the operation of the pump assembly), it should also be observed that the entire assembly can be assembled by means of an axial stacking operation, which means that assembly can be fully automated.

The invention is not limited to the embodiment described above but, on the contrary, extends to any variant which uses equivalent means to reproduce the characteristics of the claims.

We claim:

1. A steam iron pump assembly including a two-position selector having a first position for obtaining a sudden discharge of steam and a second position for obtaining a spray of cold water, the pump assembly comprising;

a pump body surmounted by a deformable bellows defining a pump chamber, the pump body having a bottom with a suction duct and first and second vertically spaced-apart side outlets each having an orifice for communicating with a central hollow of said body;

a rotary selector inside the deformable bellows and including a bottom portion disposed inside the central hollow of the pump body, and including a top actuator portion constrained to rotate with said bottom portion, said top and bottom portions being free to slide axially relative to each other; and a selectively deformable sealing sleeve directly surrounding the bottom portion of the rotary selector and axially aligned with the first and second side outlets from the pump body;

said bottom portion of the rotary selector being shaped such that when viewed in elevation and rotated to a first angular position, the sealing sleeve is deformed against the first of the outlet orifices while simultaneously distributing water to the second outlet orifice and when rotated to a second angular position, the sealing sleeve is deformed against said second outlet orifice while simultaneously distributing water to said first outlet orifice.

2. A pump assembly according to claim 1 wherein the sealing sleeve is essentially stationary in the associated central hollow of the pump body and radially deformed towards the side outlets from the pump body by the shaped bottom portion of the rotary selector.

3. A pump assembly according to claim 2, wherein the bottom portion of the rotary selector has two identically shaped sections angularly offset from each other, and spaced apart vertically to correspond with the side outlets of the pump body.

4. A pump assembly according to claim 3 wherein the two sections of the bottom portion of the rotary selector are generally rectangular in shape.

5. A pump assembly according to claim 3 wherein the two sections of the bottom portion of the rotary selector are offset by about 90°.

6. A pump assembly according to claim 5 wherein the central hollow of the pump body has a cross-section which is axially uniform, said cross-section defining a complex shape forming axial thrust faces for compressing the sealing sleeve against one or other of the outlet orifices and side depressions enabling water to pass around said sleeve.

7. A pump assembly according to claim 6, wherein two axial thrust faces are provided on either side of each outlet orifice extending substantially perpendicularly to the axis of each side outlet, and an opposite relatively larger axial facette is also provided parallel to said axial thrust faces.

8. A pump assembly according to claim 1, wherein each of the side outlets from the pump body is provided with a non-return valve preventing air from being sucked in therethrough, and facilitating pump priming.

9. A pump assembly according to claim 1, wherein the central hollow of the pump body has a cross-section which is axially uniform, said cross-section defining a complex shape forming axial thrust faces for compressing the sealing sleeve against one or other of the outlet orifices and side depressions enabling water to pass around said sleeve.

10. A pump assembly according to claim 1 wherein the top actuator portion of the rotary selector comprises an actuator lever outside the deformable bellows and an intermediate shaft passing through said bellows providing the rotary connection between said actuator lever and the bottom portion of said rotary selector.

11. A pump assembly according to claim 10, wherein the intermediate shaft includes a bottom end movably located in a complementary axial hollow in the bottom portion of the rotary selector, with the corresponding cross-sections of said intermediate shaft and said rotary selector being preferably substantially rectangular.

12. A pump assembly according to claim 11, wherein the intermediate shaft has a cylindrical portion where the shaft passes through the deformable bellows and said deformable bellows is provided with a small cylindrical sleeve for receiving said cylindrical portion with the inside wall of the small cylindrical sleeve being provided with circular grooves to improve sealing.

13. A pump assembly according to claim 11, wherein the axial hollow in the bottom portion of the rotary selector includes a bore extending to the bottom end of said portion for balancing pressure inside the pump.

14. A pump assembly according to claim 11, wherein the actuator lever is mounted on a pushbutton for actuating the pump in both the first and second angular positions of the rotary selector.

15. A pump assembly according to claim 14, wherein the actuator lever and the intermediate shaft are constituted by a single part.

16. A pump assembly according to claim 14, wherein the pushbutton and the actuator lever constitute a single part.

17. A pump assembly according to claim 16, wherein the intermediate shaft has a cylindrical portion where the shaft passes through the deformable bellows and said deformable bellows is provided with a small cylindrical sleeve for receiving said cylindrical portion, with the inside wall of the small cylindrical sleeve being provided with circular grooves to improve sealing.

18. A pump assembly according to claim 17, wherein the cylindrical portion of the intermediate shaft comes into abutment against the bottom portion of the rotary selector at the end of the pump-actuating stroke.

19. A pump assembly according to claim 1, wherein the axial hollow in the bottom portion of the rotary selector includes a bore extending to the bottom end of said portion for balancing pressure inside the pump.

* * * * *